US005177399A

United States Patent [19]

Fujiwara et al.

[11] Patent Number: 5,177,399

[45] Date of Patent: Jan. 5, 1993

[54] COLOR CATHODE RAY TUBE APPARATUS

[75] Inventors: Takeshi Fujiwara, Kumagaya; Kiyoshi Tokita; Masatsugu Inoue, both of Fukaya, all of Japan

[73] Assignee: Kabushiki Kaisha Toshiba, Kawasaki, Japan

[21] Appl. No.: 774,157

[22] Filed: Oct. 15, 1991

Related U.S. Application Data

[63] Continuation of Ser. No. 371,844, Jun. 27, 1989, abandoned.

[30] Foreign Application Priority Data

Jun. 27, 1988 [JP] Japan ..... 63-156974

[51] Int. Cl.[5] ..... H01J 29/70

[52] U.S. Cl. ..... 313/440

[58] Field of Search ..... 313/440, 414; 358/248, 358/249; 335/211, 212, 213, 214

[56] References Cited

U.S. PATENT DOCUMENTS

| | | | |
|---|---|---|---|
| 4,547,707 | 10/1985 | Yabase | 315/368 |
| 4,659,961 | 4/1987 | Naiki | 313/440 X |
| 4,782,264 | 11/1988 | Yamazaki et al. | 313/413 |

FOREIGN PATENT DOCUMENTS

| | | | |
|---|---|---|---|
| 2658729 | 6/1978 | Fed. Rep. of Germany | 313/440 |
| 53-106626 | 8/1978 | Japan . | |
| 57-45748 | 10/1982 | Japan . | |
| 58-11707 | 10/1983 | Japan . | |
| 59-3018 | 1/1984 | Japan . | |
| 60-44351 | 3/1985 | Japan . | |
| 60-7796 | 6/1985 | Japan . | |
| 62-37849 | 2/1987 | Japan . | |
| 63-207035 | 8/1988 | Japan . | |
| 0307648 | 12/1988 | Japan | 313/440 |
| 64-5817 | 2/1989 | Japan . | |
| 1567669 | 5/1980 | United Kingdom . | |

*Primary Examiner*—Sandra L. O'Shea
*Attorney, Agent, or Firm*—Cushman, Darby & Cushman

[57] ABSTRACT

Magnets for applying a pincushion type magnetic field to three electron beams emitted from an electron gun assembly is arranged between the deflection device and the lens unit of the electron gun assembly. The pincushion type stationary magnetic field produced by the magnets correct deflection aberrations of the electron beams due to the magnetic field of the deflection device and improves the focusing characteristics on the periphery of a screen.

15 Claims, 10 Drawing Sheets

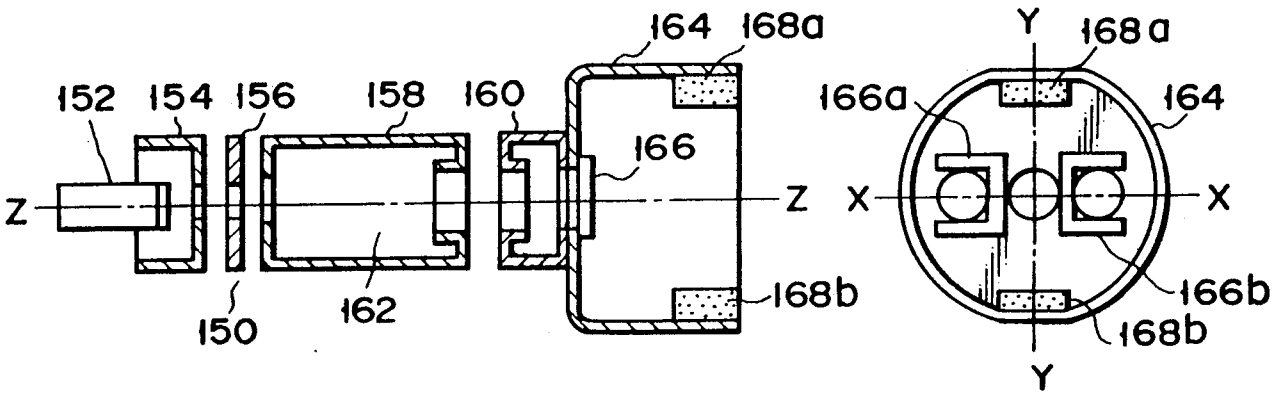
FIG. 15A
FIG. 15B
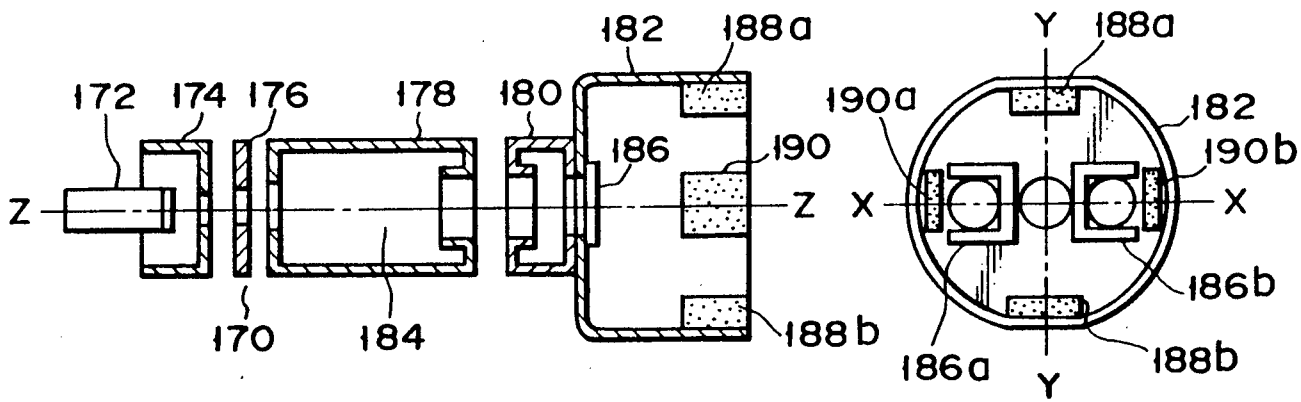
FIG. 16A
FIG. 16B

COLOR CATHODE RAY TUBE APPARATUS

This is a continuation of application Ser. No. 371,844, filed on Jun. 27, 1989, which was abandoned upon the filing hereof.

BACKGROUND OF THE INVENTION

1. Field of the Invention

This invention relates to a color cathode ray tube apparatus, and particularly to a color cathode ray tube apparatus which provides a high focusing characteristic and in which the deflection aberrations of electron-beams are reduced which are caused by the deflection magnetic field produced by a deflection device for use in the color cathode ray tube apparatus, and also relates to a deflection device for use therein.

2. Description of the Related Art

A color cathode ray tube apparatus of the shadow mask type comprises a panel section having a generally rectangular face plate and a skirt extending from a lateral edge of the face plate, a funnel section connected to the panel section, and a neck section continuously formed with the funnel section. The interior of the cathode ray tube is maintained in a vacuum state by the panel section, the funnel section and the neck section. In the neck section is housed an electron gun assembly which generates three electron beams (R), (G) and (B). At the outer lateral side of the portion of the apparatus between the funnel section and the neck section is disposed a deflection device for generating magnetic fields which deflect electron beams vertically and horizontally. A phosphor screen is formed on the inner face of the face plate of the panel. In the tube, a generally rectangular shadow mask is opposed to the face plate at a predetermined spacing. The shadow mask is made of a thin metal plate and provided with a lot of slit apertures.

The deflection device for use in the color cathode ray tube apparatus of shadow mask type has a horizontal deflection coil and a vertical deflection coil which produce magnetic fields for respectively horizontally and vertically deflecting the three electron beams (R), (G), (B) emitted from the electron gun assembly. After deflected by the horizontal and vertical deflection coils, the three electron beams (R), (G) and (B) are converged towards the corresponding slit. The electron beams (R), (G) and (B) converged at the vicinity of the slit are landed on the phosphor screen which has three kinds of phosphor stripes alternately arranged to each other. The three electron beams (R), (G) and (B) pass the slit and are incident on the phosphor screen, whereby the red light, green light and blue light are emitted from the phosphor stripes. In other words, the three beams are landed on the corresponding phosphor stripes which emit the red, green and blue light.

When the electron gun assembly is of inline type, the electron beam (G) which causes green light to be emitted is radiated from the electron gun so as to coincide with the tube axis. The electron beams (B) and (R) which cause blue light and red light to be emitted, respectively, are radiated, with the electron beam (G) disposed therebetween. The color cathode ray tube apparatus, which employs the characteristic of the inline type electron gun to produce specific non-uniform magnetic fields by means of deflection yokes, is a self-convergence type color cathode ray tube apparatus. With the color cathode ray tube of this type in which the three electron beams are radiated on the same horizontal plane, for example, a horizontal deflection magnetic field of mainly pincushion type and a vertical deflection magnetic field of mainly barrel type are applied. The impression of these magnetic fields enables the three electron beams radiated on the same horizontal plane to be converged on the phosphor screen.

However, with this inline type color cathode ray tube apparatus, the center beam (G) and the side beams (B) and (R) do not converge well each other to produce coma aberration on the peripheral portion of the screen. Japanese Patent Publications No. Sho 51-26208 and Sho 54-23208 describe an apparatus wherein an electron gun assembly is provided, for the correction of the coma aberration, with magnetic substance which changes a shape of the after-leakage magnetic field which is a part of the magnetic field generated by a deflection device. Japanese Utility Model Publication No. Sho 57-45748 discloses another apparatus in which an auxiliary coil is provided at the side of the electron gun of a deflection device and is adapted to render an electrical current to flow in synchronism with the deflection current flowing in a vertical deflection coil, thereby generating a strong pincushion type magnetic field.

With the color cathode ray tube apparatus in which the correction means for coma aberration is provided, however, the beam spots formed on a screen by the beams are distorted, because a non-uniform magnetic filed is employed as the deflection magnetic field. In other words, when a uniform magnetic field is impressed, the beam spots assume a substantially truly circular shape over the whole surface of the screen. However, referring to FIGS. 1, 2A and 2B, the beam spots 4 formed on the X-axis by the electron beams at the horizontal side end portions of the screen receive, by means of a pincushion type horizontal magnetic field, Lorentz's forces which press the electron beams above the X-axis downward and the electron beams below the X-axis upward, and the beam spots 4 are distorted to take an elliptical shape whose major axis extends horizontally. On the other hand, the beam spots 6 on the vertical axis (the Y-axis) receive, by means of a barrel type vertical deflection magnetic field 12, Lorentz's forces which press the electron beams at the right side rightwards and press the electron beams at the left side leftwards. The beam spots 4 are distorted to assume an elliptical shape whose major axis extends horizontally. The side beams receive Lorentz's forces whose magnitudes are different from each other at the right side and at the left side. In addition, the directions of the Lorentz's forces exerted on the electron beam (B) and the electron beam (R) are reversed to each other. Therefore, the beam spots formed by the two side beams at the vertical end sides at the vicinity of the vertical axis assume elliptical shapes whose major axes are crossed each other. As a result, the focusing characteristic at the peripheral portion of the screen is remarkably deteriorated due to the deformation and inclination of the beam spots caused by the horizontal and vertical deflection magnetic fields. The deterioration of the focusing characteristic is a serious cause that prevents the electron gun assembly from being highly efficient.

Accordingly, such compromise must be made for designing a color cathode ray tube apparatus that the focusing characteristic of the central portion of the screen is lowered to improve the focusing characteristic of the peripheral portion of the screen, thereby obtaining a uniform focusing characteristic over the whole area of the screen.

For the auxiliary coils as described in Japanese Utility Model Publication No. Sho 57-45748, the following defects are developed. Since an electrical current flows in synchronism with the deflection current flowing in the vertical deflection coil, a magnetic field for directing the beams vertically is produced, which is directed in the horizontal direction on the horizontal axis. The beams are excessively deflected by the magnetic filed at the side of the electron gun assembly of the deflection device and likely collide with the inner wall of the neck section. This causes on the shadow a so-called neck shadow which is a portion on which no beams arrive (that is, a non-luminous portion). The auxiliary coil comprises a magnetic substance and a coil wound therearound in which an electrical current flows. Thus, it is expensive as a correction element. In many cases, the impedances of the deflection devices are changed according to the requests of set makers which manufacture TV sets using color cathode ray tube apparatuses. When the impedance is changed, the current flowing in the deflection coil is also changed. Therefore it is necessary to modify the specification of the auxiliary coil according to the impedance of the deflection coil, in order to produce a proper effect of the auxiliary coil on the deflection device. This hinders the mass production of the color cathode ray tube apparatuses.

SUMMARY OF THE INVENTION

The object of this invention is to provide a color cathode ray tube apparatus which renders small the distortions of the beam spots of electron beams which are caused by the deflection magnetic field produced by a deflection device thereby to reduce the deflection aberrations and which prevents the deterioration of the focusing characteristic of the peripheral portion of a screen to obtain a good focusing characteristic over the screen, and to provide a deflection device for use therein.

A color cathode ray tube apparatus according to this invention comprises:

a vacuum envelope including an axis, a panel section, a funnel section and a neck portion, the panel section having a face plate with a substantially rectangular front face and an inner face and a skirt extending from the peripheral edge of the face plate, the funnel section being formed continuous to the skirt of the panel section, and the neck section being formed substantially cylindrical and continuous to the funnel section;

a phosphor screen formed on the inner face of the face plate;

a shadow mask arranged in the panel section to face the phosphor screen on the face plate;

an electron gun assembly provided in the neck portion and comprising an electron beam generator for producing three electron beams constituting a center beam and two side beams and an electron lens unit for focusing the three electron beams, the electron gun assembly being of inline type which emits the three electron beams in parallel to each other so as to travel on a plane;

a deflection device arranged on the outer peripheral portion of the boundary between the funnel section and the neck section and comprising two deflection means, the first deflection means for producing mainly a pincushion type deflection magnetic field to deflect the three electron beams in a first direction in which they are arranged and the second deflection means for producing mainly a barrel type deflection magnetic field to deflect the three electron beams in a second direction perpendicular to the first direction;

at least a pair of permanent magnets which produces a pincushion type stationary magnetic field arranged symmetrically with respect to the axis between the deflection device and the electron lens unit such that their facing magnetic polarities are reversed to each other.

Further, a color cathode ray tube apparatus according to this invention comprises a vacuum envelope including an axis, a panel section, a funnel section and a neck section, the panel section having a front plate with a substantially rectangular front face and a inner face and a skirt extending from the peripheral edge of the face plate, the funnel section being continuous to the skirt of the pane section, and the neck section being formed substantially cylindrical and continuous to the funnel section;

a phosphor screen formed on the inner face of the face plate;

a shadow mask arranged in the panel section so as to face the phosphor screen on the face plate;

an electron gun assembly comprising an electron beam generator for producing three electron beams constituting a center beam and two side beams and an electron lens unit for focusing the three electron beams, the electron gun assembly being of inline type which emits the three electron beams in parallel to each other so as to travel on a plane;

a deflection device arranged on the outer peripheral portion of the boundary between the funnel section and the neck section and comprising two deflection means, the first deflection means for producing mainly a pincushion type deflection magnetic field to deflect the three electron beams in a first direction in which they are arranged and the second deflection means for producing mainly a barrel type deflection magnetic field to deflect the three electron beams in a second direction perpendicular to the first direction; and at least two pairs of permanent magnets for producing stationary magnetic fields, each pair of the permanent magnets being arranged symmetrical with respect to the axis between the electron gun side portion of the deflection device and the electron lens unit such that their facing magnetic polarities are reversed to each other, one pair of the magnets being arranged in parallel to the first direction and the other pair of magnets being arranged perpendicularly to the first direction.

A deflection device according to this invention is provided on the outer peripheral portion of the boundary between a funnel section and a neck section and comprises the first deflection means used for producing mainly a pincushion type magnetic field to deflect three electron beams emitted from an electron gun assembly in a first direction in which they are arranged, the second deflection means for producing mainly a barrel type deflection magnetic field to deflect the three electron beams in a second direction perpendicular to the first direction, and at least one pair of permanent magnets arranged symmetrical with respect to an central axis at the deflection device such that their facing magnetic polarities are reversed to each other.

Further, a deflection device according to this invention provided on the outer peripheral portion of the boundary between a funnel section and a neck section comprises the first deflection means and used for producing mainly a pincushion type magnetic field to deflect three electron beams emitted from an electron gun assembly in a first direction in which they are arranged, the second deflection means used for producing mainly a barrel type deflection magnetic field to deflect the three electron beams in a second direction perpendicular to the first direction, and at least two pairs of permanent magnets for producing stationary magnetic fields so as to correct deflection aberrations, each pair of the permanent magnets being arranged symmetrically with respect to an central axis at the deflection device such that their facing magnetic polarities are reversed to each other, one pair of the permanent magnets being arranged in parallel to the first direction and the other pair of the magnets being arranged perpendicularly to the first direction.

According to this invention, the provision of the magnetic field controlling elements improves the electron-beam converging characteristic of the overall area of the screen and enhances the focusing characteristic at the peripheral portion of the screen.

BRIEF DESCRIPTION OF THE DRAWINGS

FIG. 15A is a longitudinal cross-sectional view of a third embodiment of the electron gun assembly according to this invention;

FIG. 15B is a front view of the electron gun assemble of FIG. 15A;

FIG. 16A is a longitudinal cross-sectional view of a fourth embodiment of the electron gun assembly according to this invention; and FIG. 16B is a front view of the electron gun assembly of FIG. 16A.

DETAILED DESCRIPTION OF THE PREFERRED EMBODIMENTS

Embodiments of this invention will be explained with reference to the drawings.

Figure 1:
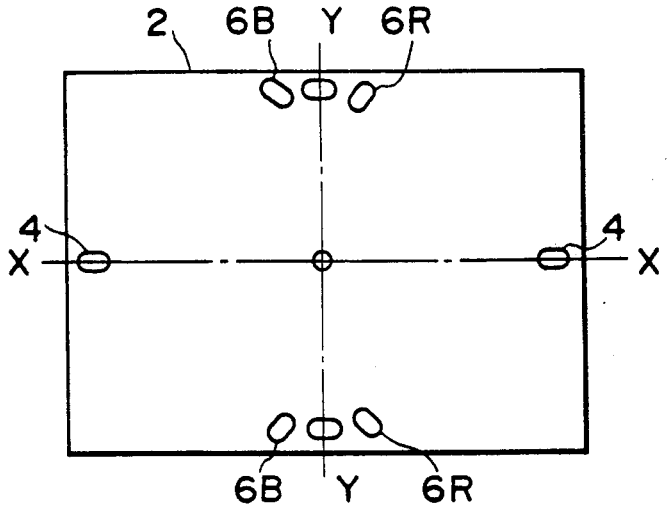
( PRIOR ART ) F I G. 1
FIG. 1 shows the shapes of the spots of the electron beams deflected in a non-uniform magnetic field produced by a conventional deflection device.
Figure 2A:
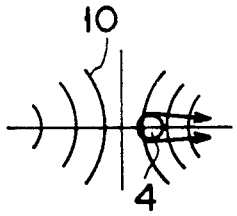
( PRIOR ART ) F I G. 2A
FIG. 2A illustrates how electron beams are exerted by forces in a pincushion type horizontal deflection magnetic field.
Figure 2B:
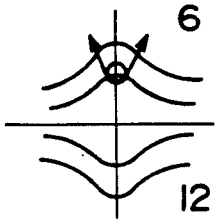
( PRIOR ART ) F I G. 2B
FIG. 2B explains how electron beams are exerted by forces in a barrel type vertical deflection magnetic field.
Figure 3:
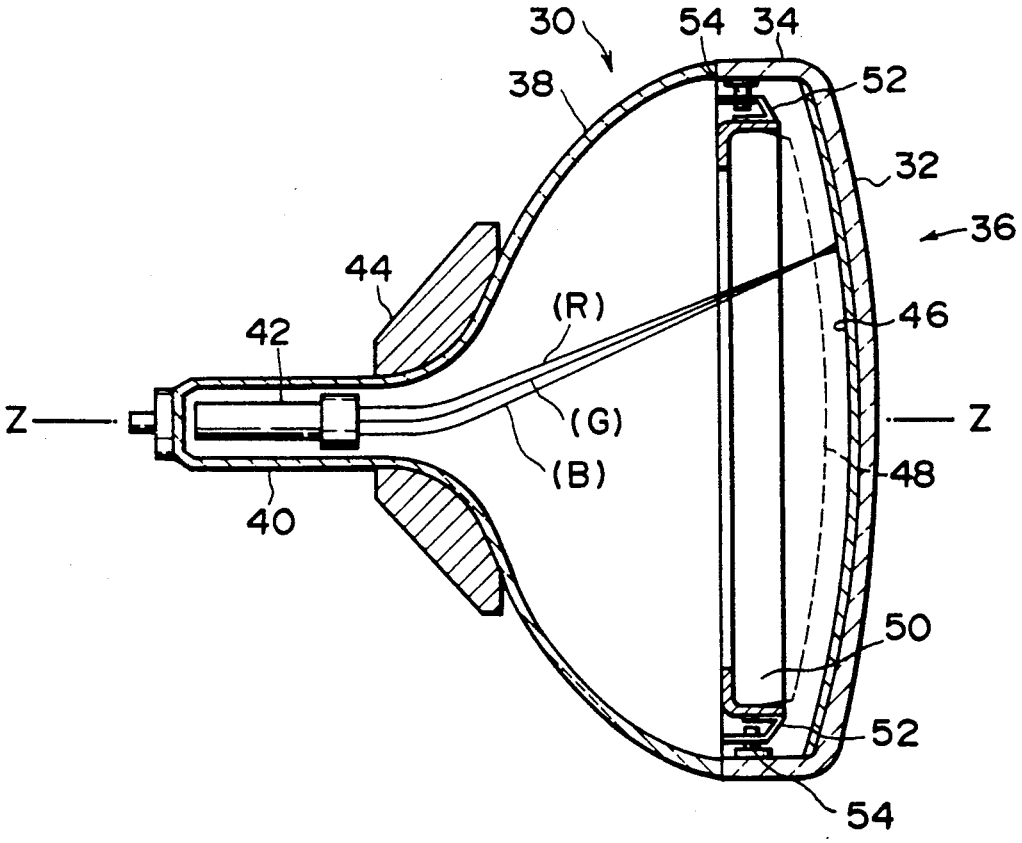
FIG. 3 is a longitudinal cross-sectional view of a color cathode ray tube apparatus according to this invention.

In FIG. 3 is shown a color cathode ray tube apparatus of self-convergence type 30, which comprises a panel section 36 having a substantially rectangular face plate 32 and a skirt 34 extending from the peripheral edge of the face plate 32, a funnel section 38 connected to the skirt 34 and a neck section 40 formed continuous to the funnel section 38. The interior of the color cathode ray tube 30 is held in a vacuum state by means of the panel section 36, the funnel section 38 and the neck section 40. Within the neck portion 40 is housed an inline type electron gun assembly 42 which generates three electron beams (R), (G) and (B) such that they fall on the same horizontal plane. On the outer periphery of the adjacent parts of the cone portion of the funnel section 38 and the neck section 40 is mounted a deflection device 44 which generates deflection magnetic fields. A phosphor screen 46 is formed on the inner face of the face plate 32 of the panel section 36. The phosphor screen 46 comprises three phosphor layers which are arranged alternately in a stripe fashion and are excited by three electron beams to emit red light, green light and blue light, respectively. Within the tube 30 is disposed a rectangular shadow mask 48 so as to face the phosphor screen 46. The shadow mask 48 is formed from a thin metal plate and is provided with a great number of slit apertures. The shadow mask 48 is used to land the three electron beams from the electron gun assembly 42 on the predetermined phosphor layers. A metallic mask frame 50 surrounds the shadow mask 48. To the mask frame 50 is welded a plurality of elastic supporting members 52 which are elastically deformable. Within the skirt 34 are provided a plurality of panel pins 54 which engage the supporting members 52.

Figure 4:
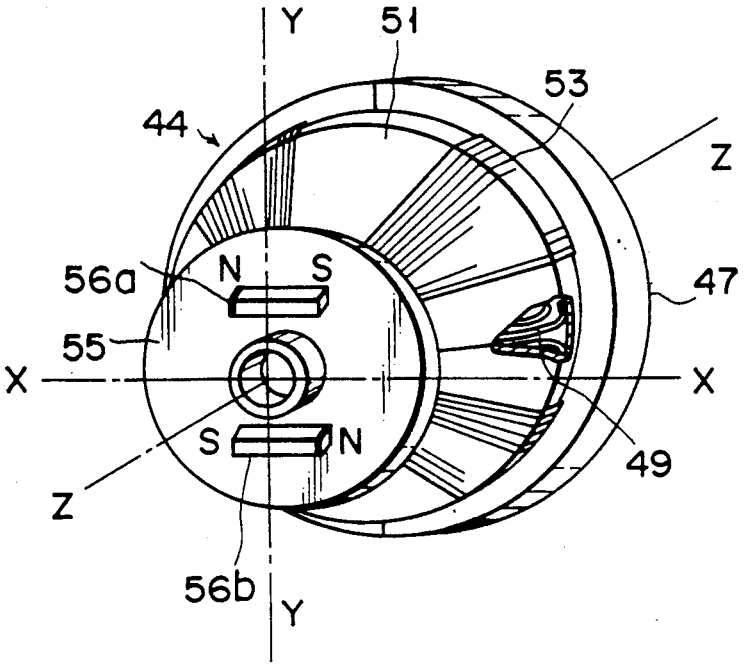
FIG. 4 is a perspective view of a deflection device according to this invention.
Figure 5:
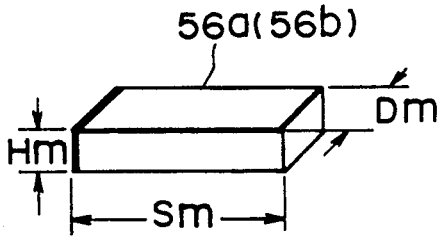
FIG. 5 is a perspective view of a permanent magnet used for this invention.

After deflected horizontally and vertically by the non-uniform magnetic field produced by the deflection device 44, the three electron beams (R), (G and (B) radiated from the electron gun assembly 42 converge towards the slits of the shadow mask 48. The color cathode ray tube 30 is of self-convergence type. As shown in FIG. 4, the deflection device 44 comprises, for example, a pair of horizontal deflection coils 49 wound in a saddle form and mounted in a separator 47 symmetrically with respect to the horizontal axis (X-axis) and a pair of vertical deflection coils 53 wound around the core 51 and mounted on the outer face of a separator 47. The horizontal deflection coils 49 of the deflection device 44 mainly produce pincushion type deflection magnetic field which deflects the three electron beams radiated from the electron gun assembly 42 horizontally (that is, in the X directions). The vertical deflection coils 53 mainly generates a barrel type deflection magnetic field which deflects the three electron beams vertically (that is, Y direction). The color cathode ray tube 30 is provided with a pair of permanent magnets 56*a* and 56*b*on an end portion of electron gun side 55 of the deflection device 44 and which are symmetrical with respect to the central axis of the deflection device 44 (which coincides with the Z-axis) and parallel to the XY plane. The permanent magnets 56*a* and 56*b* are arranged such that their facing poles exhibit reverse magnetic polarities. Each of these magnets assumes a regular parallelepiped shape as shown in FIG. 5 and is made of oxide magnetic substance. The size of the magnet is such that Sm (length)=6 mm, Hm (thickness)=3 mm and Dm (width)=3.5 mm or the like. The magnetic flux density at the central portion of the pole surface of the magnets 56*a* and 56*b* is approximately 1500 Gauss/square centimeter.

Figure 6A:
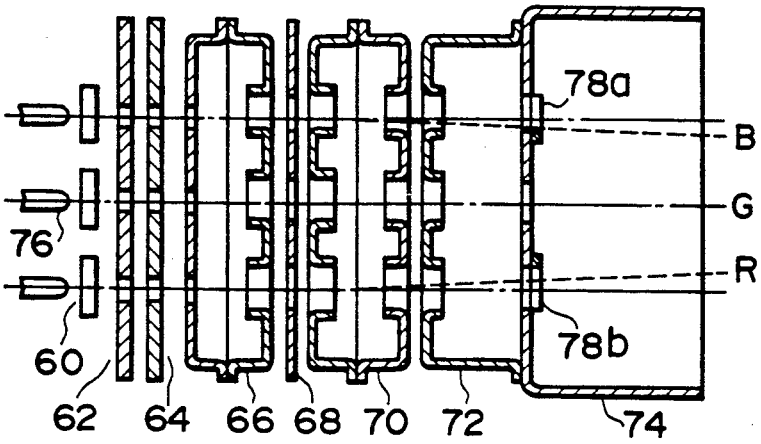
FIG. 6A is a longitudinal cross-sectional view of an electron gun assembly.
Figure 6B:
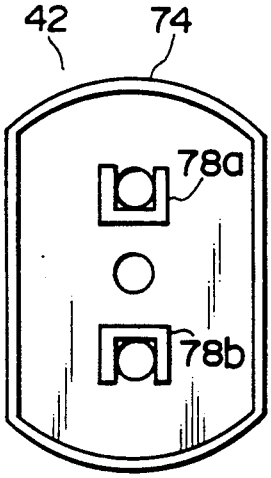
FIG. 6B is a front view of the electron gun assembly of FIG. 6A.
Figure 7:
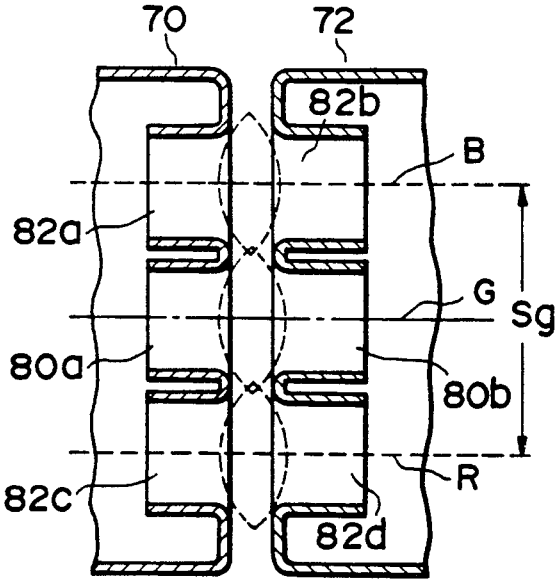
FIG. 7 is an enlarged longitudinal cross-sectional view of a part of the electron gun assembly of FIG. 6A.

In FIGS. 6A and 6B is shown the electron beam assembly 42 used in the color cathode ray tube 30. The electron beam assembly 42 comprises three independent cathodes 60 serially and horizontally arranged, a first grid 62 and a second grid 64 both used for controlling the emitted electrons to form electron beams, a third grid 66, a fourth grid 68 and a fifth grid 70 and a sixth grid 72, the grids 66, 68, 70 and 72 comprising an electron lens unit and being used for accelerating three electron beams (R), (G) and (B) and enabling them to focus, and a convergence cup 74 fixed to the grid 72. Heaters 76 are provided for heating the cathodes 60. The grids 62, 64 and 68 are formed in a plate form and have electron beam passing holes. The grids 66, 70 and 72 are formed in a hollow cylindrical electrodes of a unitary construction and have also electron beam passing holes. FIG. 7 shows the grids 70 and 72 of the electron gun assembly 42. Center beam passing holes 80*a* and 80*b* and side beam passing holes 82*a*, 82*b*, 82*c* and 82*d* are formed in the grids 70 and 72 so as to be aligned with each other, respectively. The space between the side beam passing holes or the distance Sg between a pair of side beams passing the main lens portion is approximately 6.6 mm when the length Sm of the magnet 56 is 6 mm. At peripheral portions of side beam passing holes formed in the bottom of the convergence cup 74 are disposed magnetic field controlling elements 78*a* and 78*b* made of magnetic substance for correcting comas and which have been changed the after-leakage of the magnetic field of the deflection device 44.

Figure 8:
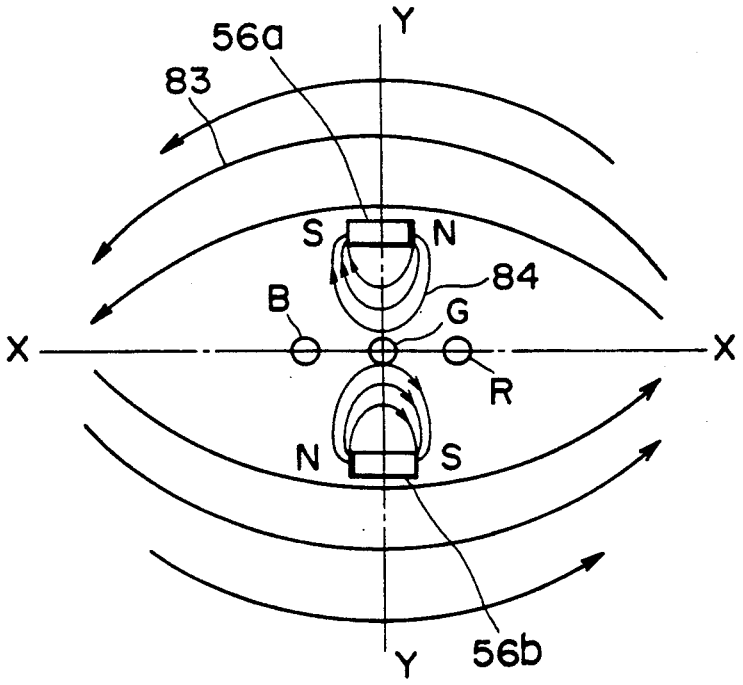
FIG. 8 shows how a pincushion type magnetic field produced by permanent magnets acts on electron beams.

The permanent magnets 56*a* and 56*b* are arranged with their reverse magnetic polarities facing each other. The distance between the poles of the magnets 56*a* and 56*b* is smaller than the distance between the paired side beams. As shown in FIG. 8, the vertical deflection coils 52 generate a barrel type vertical deflection magnetic field 83, and the magnets 56*a* and 56*b* produce a pincushion type strong magnetic field 84 in the area in which the three electron beams pass. When the magnets 56*a* and 56*b* are not used, therefore, the spots of the three electron beams on the phosphor screen assume an elliptical form with the major axis extending horizontally by Lorentz's forces due to the barrel type vertical deflection magnetic field, and the spots of the side beams are inclined. When the magnets 56*a* and 56*b* are used, however, the electron beams are exerted by vertical Lorentz's forces due to the pincushion type magnetic field, whereby the elliptical deformation and inclination of the spots are corrected.

These permanent magnets are simpler in construction and smaller than the conventional auxiliary coils. They are manufactured at a low cost and are suited for mass production. Further, since the permanent magnets produce stationary magnetic fields, the beam spots have an improved shape over the whole screen, when the beam spots at the vicinity of the vertical axis are suitably corrected.

The magnetic correcting elements mounted on the bottom of the convergence cup 74 enables to correct the convergence in accordance with the deflection current of the deflection device and also enables the convergence or comas at the periphery of the screen to be corrected such that an improved converging characteristic obtained over the whole screen. Particularly, with a large-sized color cathode ray tube, uniform focusing and converging characteristics are required over the whole area of the screen. When auxiliary coils are used with which the adjustment of such characteristics over the whole area of the screen is difficult, it is not easy to obtain the uniform focusing and converging characteristics throughout the screen. On the other hand, the use of the permanent magnets 56*a* and 56*b* facilitates this adjustment.

Figure 9:
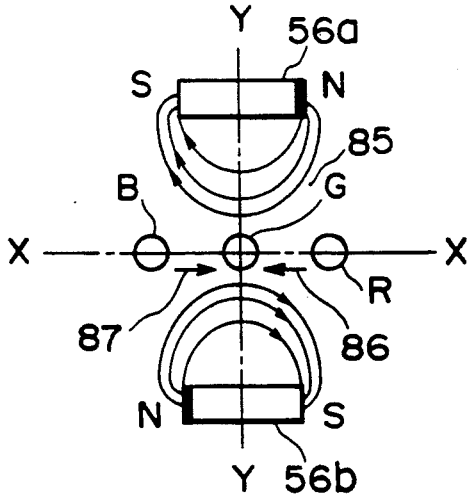
FIG. 9 illustrates a static convergence action of pincushion type magnetic fields produced by permanent magnets.

As shown in FIG. 9, a pincushion type magnetic field generated by the paired permanent magnets 56*a* and 56*b* is applied to the paired side beams. The side beams are exerted by Lorentz's forces in directions as indicated by arrows 86 and 87, respectively. By using permanent magnets having a suitable magnetic intensity, the three electron beams (R), (G) and (B) are converged on a point at the center of the screen. Thus, the static convergence characteristic is improved.

In order to establish the static convergence, the conventional electron gun assembly has the following structure:

Two adjacent grids constituting the principal lens are arranged such that the side beam passing holes formed in one grid at the side of the screen are separated from the center beam more than those of the other grid at the side of the cathode. Thus, the electrostatic lens is of asymmetrical type.

Alternately, a static electric lens formed between adjacent two grids is disposed so as to be inclined with respect to a pair of side beams.

The electron gun assembly having such a structure requires electrodes of two kinds of different shapes.

When the permanent magnets 56*a* and 56*b* according to this invention are employed, they statically converge the electron beams. Accordingly, the electron beam assembly according to this invention does not have a static convergence function and is constructed, for example, such that the three electrons are emitted in parallel to each other. The electron gun assembly constructed as described above can be manufactured at a low cost and its assembling accuracies are enhanced.

A pair of permanent magnets 56*a* and 56*b* can be used for controlling not only parallel electron beams but inclined beams when the size, the arrangement and the intensity of magnetic fields of the permanent magnets are properly selected.

Figure 10:
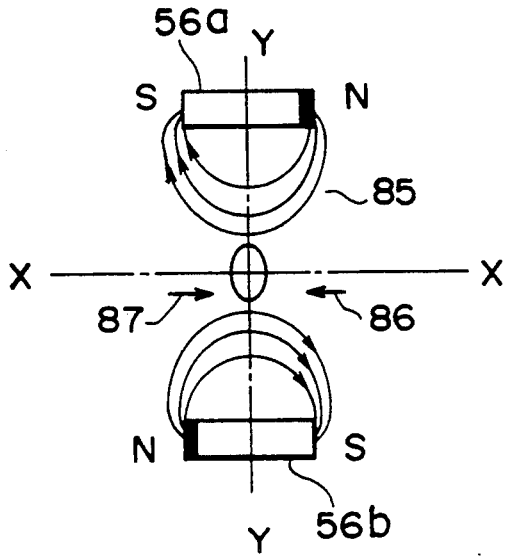
FIG. 10 explains an irrotational symmetrical lens function of a pincushion type magnetic field produced by a pair of permanent magnets.
Figure 11:
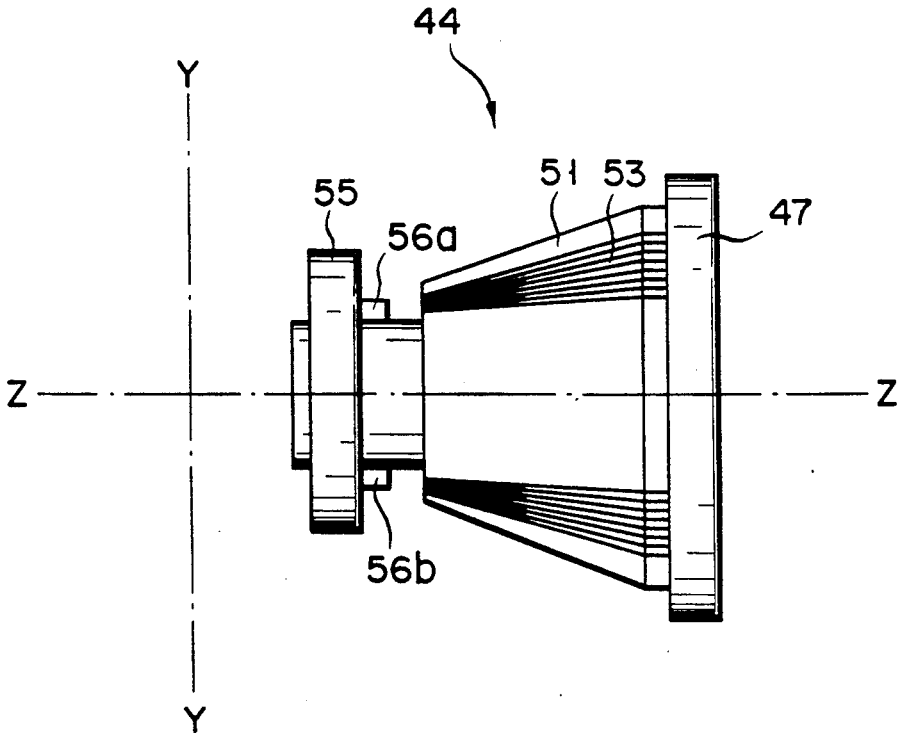
FIG. 11 is a side view of a modification of the first embodiment of the deflection device.

Referring to FIG. 10, an electron beam is applied to by a pincushion type strong magnetic field 85 produced by a pair of permanent magnets 56*a* and 56*b*. Then, the beam spot is exerted by Lorentz's forces and is deformed into an elliptical shape with its major axis extending vertically (that is, in the Y directions). Thus, these permanent magnets function as an irrotational symmetrical lens which deforms the electron beams into an elliptical form. Therefore, the electron gun assembly should not use an irrotational symmetrical type lens but a rotational symmetrical type lens, whereby it is manufactured at a low cost and has an improved reliability. The distance between the poles, the intensity of magnetization, the shape and the like of the paired permanent magnets are arbitrarily selected. Then, the permanent magnets are rendered small and disposed at more places than the auxiliary coils. For example, the permanent magnets can be placed between the electron gun side portion of the deflection device and the core. A deflection device having these permanent magnets is shown in FIG. 11. The permanent magnets 56*a* and 56*b* are arranged between the deflection device 44 and the electron gun assembly 42.

Figure 12:
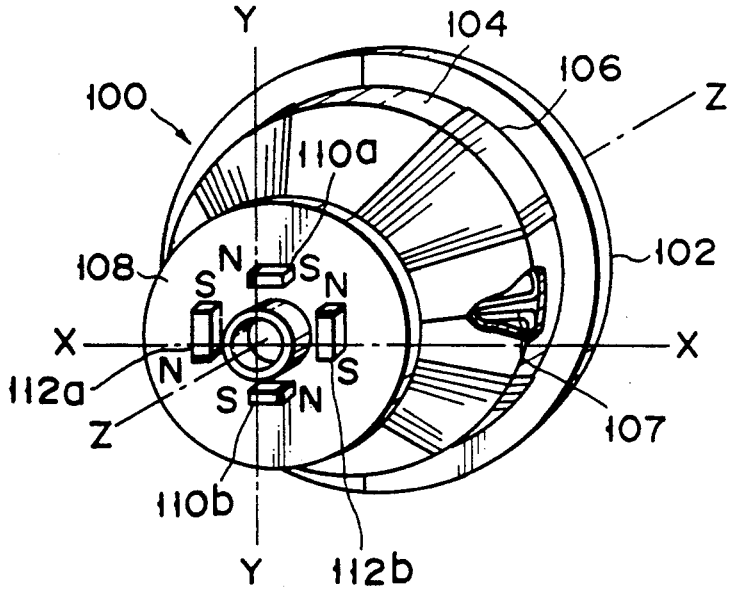
FIG. 12 is a perspective view of a second embodiment of the deflection device according to this invention.

There will now be explained the second embodiment which is also used in an inline color cathode ray tube of self convergence type like the first embodiment. As shown in FIG. 12, a deflection device 100 of the second embodiment comprises a pair of horizontal deflection coils 107, for example, wound in a saddle form and mounted in a separator 102 symmetrically with respect the X-axis, and a pair of vertical deflection coils 106 wound around the core 104 and mounted on the outer face of the separator 102. The horizontal deflection coil 107 mainly generates a pincushion type deflection field for deflecting horizontally (in the X direction) the three electron beams emitted from the electron gun assembly. The vertical deflection coil 106 produces mainly a barrel type deflection magnetic field for deflecting the three electron beams in the direction (the Y direction) perpendicular to the direction in which the three electron beams are arranged. On the electron gun side portion 108 of the deflection device 100, a pair of permanent magnets 110*a* and 110*b* are mounted symmetrically with respect to the central axis (that is, the Z-axis) and are disposed in parallel to the XZ plane with their middle portions located on the Y-axis; and, similarly, a pair of permanent magnets 112*a* and 112*b* are mounted symmetrically with respect to the central axis and are disposed in parallel to the YZ plane with their middle portions located on the X-axis). The permanent magnets 110*a*, 110*b*, 112*a* and 112*b* are rectangular and are made of oxide magnetic substance. The magnetic flux density at the central portion of the pole surfaces of the permanent magnets 110*a* and 110*b* is 1500 Gauss/square centimeter, while those of the permanent magnets 112*a* and 112*b* is 1300 Gauss/square centimeter.

The permanent magnets 110*a* and 110*b* arranged as described above generates a pincushion type strong magnetic field, in addition to a barrel type vertical deflection magnetic field generated by the vertical deflection coils. The electron beams are exerted not only by the Lorentz's forces due to the barrel type magnetic field but also by the Lorentz's forces which deform the spots of the electron beams into an elliptical shape with their major axis extending vertically. As a result, the beam spots are prevented from being deformed on the screen into an elliptical form with their major axis extending horizontally, and the inclination of the spots of the paired side beams is also avoided.

Figure 13:
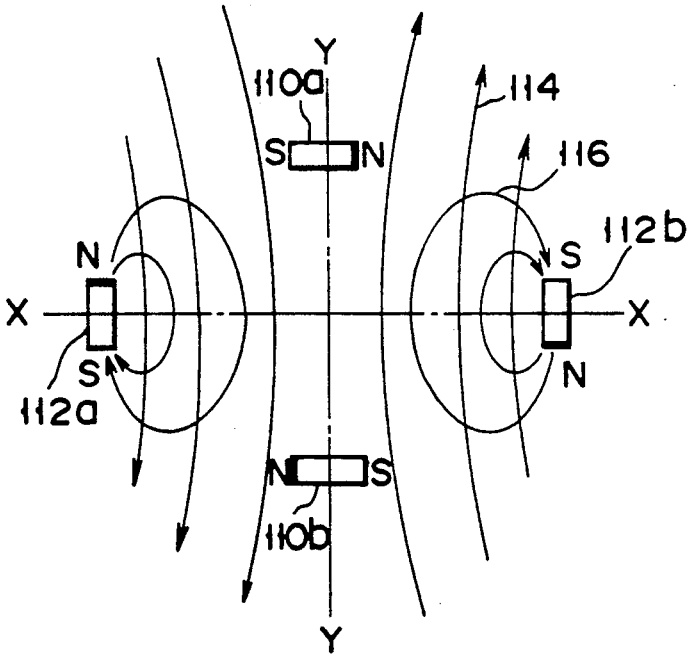
FIG. 13 shows how a pincushion type magnetic field acts which is produced by magnets arranged on both sides in this figure.
Figure 14:
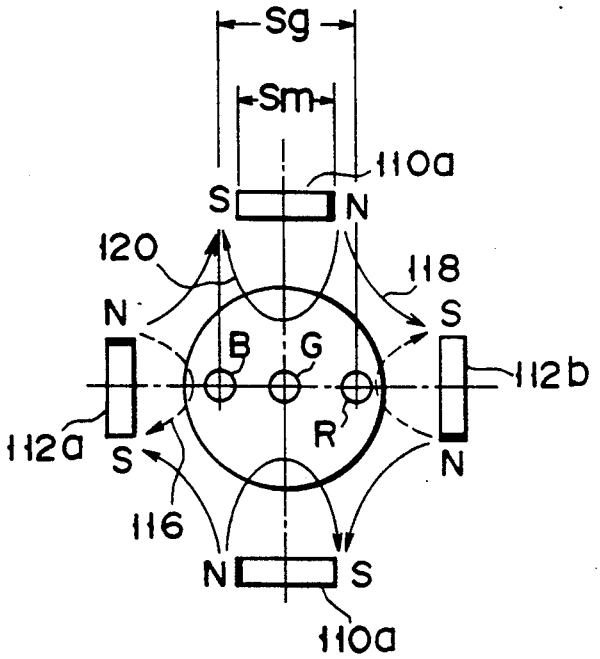
FIG. 14 explains how a pincushion type magnetic field acts which is produced by two pairs of magnets.

In FIG. 13, the pair of the permanent magnets 112*a* and 112*b* generate a pincushion type magnetic field 116 directed in the same direction of the horizontal deflection magnetic field 114 produced by the horizontal deflection coils 107. As shown FIG. 14, magnetic field 118 is generated between the magnets 112*a* and 112*b* as one party and the magnets 110*a* and 110*b* as the other party. The magnetic field 118 exerts Lorentz's forces in the directions opposite to those in which the paired side beams are inclined due to the vertical deflection magnetic field, so as to effectively compensate the inclination of the spots.

It is preferred that the length Sm of the permanent magnets 110*a* and 110*b* should be shorter than the distance Sg between the side beams in order to effectively act the magnetic field 118 on the paired side beams. In this arrangement, a pair of side beams approach the center beam by the pincushion type magnetic field generated by the permanent magnets 110*a* and 110*b*, while the side beams are separated from the center beam by the pincushion type magnetic field generated by the permanent magnets 112*a* and 112*b*. Therefore, the deflection device 100 cooperates with an electron gun assembly which is different from the first embodiment of the electron gun assembly and is inclined so that the side beams are directed to the center of the phosphor screen 46.

Like the first embodiment, comas are reduced by correcting the converging characteristic at the periphery of the screen by means of the electron gun assembly. Further, the distances of the permanent magnets, the intensities of magnetization and shapes of the magnets are selected without any limitations. In other words, since the magnets can be set at various places, the deflection device can be made small.

FIGS. 15A and 15B show a third embodiment of this invention in which an electron gun assembly is provided with permanent magnets. The electron gun assembly 150 of this invention comprises three independent cathodes 152 arranged in parallel to each other on a horizontal plane including the X-axis, an electron beam generator having a first grid 154 and a second grid 156 both for controlling electrons emitted from the cathodes 152, and a lens unit having a third grid 158 and a fourth grid 160 both for accelerating and focusing three electron beams emitted from the electron beam generator. The electron gun assembly 150 is of bipotential type and has a convergence cup 164 connected to the fourth grid 160. Magnetic field control elements 166*a* and 166*b* made of magnetic substance surround side beam passing holes formed in the bottom of the convergence cup 164. Within the convergence cup 164 are arranged a pair of permanent magnets 168*a* and 168*b* symmetrically with respect the central axis 162 (Z-axis) of the electron gun assembly 150 such that their facing poles have opposite polarities. The distance between the poles of each permanent magnet is smaller than the distance between the side beams. With the third embodiment, the same technical advantages are obtained as with the first embodiment.

FIGS. 16A and 16B show a fourth embodiment of this invention in which a bipotential type electron gun assembly similar to that used in the third embodiment is employed. The electron gun assembly 170 comprises cathodes 172, a first grid 174, a second grid 176, a third grid 178, a fourth grid 180 and a convergence cup 182. On the bottom of the convergence cup 182 are mounted magnetic field control elements 186*a* and 186*b* made of magnetic substance. Two pairs of permanent magnets 188*a* and 188*b* and 190*a* and 190*b* are arranged symmetrically with respect to the central axis 184 (Z-axis) of the electron gun assembly 180 within the convergence cup 182 such that the facing poles of each pair of the permanent magnets have reverse polarities. The magnets 188*a* and 188*b* are arranged in parallel to the XZ plane, whereas the magnets 190*a* and 190*b* are arranged in parallel to the YZ plane. The length of the vertical permanent magnets 188*a* and 188*b* is smaller than the distance between a pair of side beams which have passed the electron lens unit. The magnetic flux density of the pole surface of the permanent magnets 188*a* and 188*b* is larger than that of the permanent magnets 190*a* and 190*b*. As a result, the magnets 188*a* and 188*b* generate a strong pincushion magnetic field than the magnets 190*a* and 190*b*. With the fourth embodiment, the same technical advantages are obtained as with the second embodiment.

The permanent magnets are mounted on the inner periphery of the convergence cup in the third and fourth embodiments. However, they can be arranged on the grids which form the lens unit of the electron gun assembly. When, however, the pincushion type magnetic field produced by the permanent magnets are subject to the lens unit of the electron gun assembly, the side beams do not pass the center of the lens unit, and coma aberration occur. Therefore, it is necessary to provide permanent magnets on the lens unit in order to eliminate the effect of the pincushion type magnetic field produced by the permanent magnets.

This invention is not limited to the above-mentioned embodiments but is applicable to color cathode ray tubes or color cathode ray tube apparatuses having electron gun assemblies. The magnetic control elements are not limited to those of the embodiments and can assume various shapes according to the kinds of the color cathode tubes and/or the deflection devices.

What is claimed is:

1. A cathode ray tube apparatus comprising:

a vacuum envelope including an axis, a panel section, a funnel section and a neck section, said panel section having a face plate with a substantially rectangular front face and an inner face and a skirt extending from a peripheral edge of said face plate, said funnel section having an outer periphery and being continuous with said skirt of said panel section, and said neck section having an outer periphery and being formed substantially cylindrically and continuous with said funnel section;

a phosphor screen formed on said inner face of said face plate;

a shadow mask arranged in said panel section so as to face said phosphor screen on said face plate;

an in-line electron gun assembly provided in said neck section and comprising an electron beam generator for producing three electron beams constituting a center beam and two side beams, and an electron lens unit for focusing said three electron beams, said electron gun assembly being of an in-line type for emitting said three electron beams in parallel to each other so as to travel on a plane; and a deflection device arranged on said outer peripheries of said funnel section and said neck section and comprising two deflection means, the first deflection means for producing mainly a pincushion type deflection magnetic field to deflect said three electron beams in a first direction in which said three electron beams are arranged and the second deflection means for producing mainly a barrel type deflection magnetic field to deflect said three electron beams in a second direction perpendicular to said first direction, at least one pair of permanent magnets arranged between the electron lens unit of the electron gun assembly and that end of the deflection device which is closer to the electron gun assembly, wherein, defining the tube axis as a Z-axis, the in-line direction of the electron beams as an X-axis, and the direction perpendicular to both the Z-axis and the X-axis as a Y-axis, and where the X-axis and the Z-axis together define an XY plane, said at least one pair of magnets are located in the XY plane and arranged around the Z-axis clockwise when viewed from the phosphor screen, said at least one pair of magnets including a first magnet oriented symmetrical to said Y-axis and such that an N pole thereof is adjacent the Y-axis and a second magnet oriented such that an N pole thereof is directed to an S pole of the first magnet to produce a pincushion type stationary magnetic field for correcting deflection aberrations of said three electron beams by said second deflection means and statically converging said three electron beams, said pair of permanent magnets being arranged symmetrically with respect to said axis of said vacuum envelope, and wherein a length of said permanent magnets is shorter than a distance between said two side beams emitted from said electron gun assembly.

2. The apparatus according to claim 1, wherein said permanent magnets are provided in said electron gun assembly.

3. The apparatus according to claim 1, wherein coma correcting means is provided at said electron gun assembly and comprises magnetic substances which change an after-leakage of the magnetic field of said deflection device.

4. The apparatus according to claim 1, wherein each of said permanent magnets is arranged in parallel to said first direction.

5. A deflection device as in claim 1, wherein said at least one pair of permanent magnets is arranged on an end surface of said electron gun assembly and extending from said end surface.

6. A color cathode ray tube assembly comprising:

a vacuum envelope including an axis, a panel section, a funnel section and a neck section, said panel section having a face plate with a substantially rectangular front face, an inner face and a peripheral edge and a skirt extending from said peripheral edge, said funnel section having an outer periphery and being continuous with said skirt of said panel section and said neck section having a substantially cylindrical shape and an outer periphery and being continuous with said funnel section;

a phosphor screen formed on said inner face of said face plate;

a shadow mask arranged in said panel section so as to face said phosphor screen on said face plate;

an in-line electron gun assembly provided in said neck portion and comprising an electron beam generator for generating three electron beams constituting a center beam and a pair of side beams and an electron lens unit for focusing and for emitting said three electron beams such that said three electron beams travel on a plane; and a deflection device arranged on said outer peripheries of said funnel section and said neck section and comprising two deflection means, the first deflection means for producing mainly a pincushion type magnetic field to deflect said three electron beams in a first direction in which said three electron beams are arranged and the second deflection means for producing mainly a barrel type deflection field to deflect said three electron beams in a second direction perpendicular to said first direction, at least two pairs of permanent magnets which produce stationary magnetic fields for correcting deflection aberrations, arranged between the electron lens unit of the electron gun assembly and that end of the deflection device which is closer to the electron gun assembly, wherein, defining the tube axis as a Z-axis, the in-line direction of the electron beams as an X-axis, and the direction perpendicular to both the Z-axis and the X-axis as a Y-axis, and where the X-axis and the Z-axis together define an XY plane, said at least one pair of magnets are located in the XY plane and arranged around the Z-axis clockwise when viewed from the phosphor screen, said at least two pairs of magnets including a first magnet oriented symmetrical to said Y-axis and such that an N pole thereof is adjacent the Y-axis and a second magnet oriented such that an N pole thereof is directed to an S pole of the first magnet, one pair of said at least two pair of permanent magnets that includes said first magnet also including a third magnet, and also arranged symmetrically with respect to said Z axis, said one pair having reverse poles opposed to each other, the other pair of said at least two pair of permanent magnets including said second magnet and also a fourth magnet being arranged in a direction perpendicular to said Z axis direction and symmetrically with respect to said Z-axis and having reverse poles opposed to each other wherein a magnetic flux density of said one pair of said permanent magnets is larger than that of said another pair of said permanent magnets at central portions of pole surfaces thereof, and wherein a length of said permanent magnets is shorter than a distance between the two side beams emitted from said electron gun assembly.

7. The apparatus according to claim 6, wherein said permanent magnets are provided in said electron gun assembly.

8. The apparatus according to claim 6, wherein coma correction means is provided at said electron gun assembly and comprises magnetic substances which change an after-leakage of the magnetic field of said deflection device.

9. A deflection device as in claim 6, wherein said at least one pair of permanent magnets is arranged on an end surface of said electron gun assembly and extending from said end surface.

10. A deflection device for use in a color cathode ray tube including an axis, a panel section, a funnel section having an outer periphery and a neck portion having an in-line type electron gun assembly housed therein for producing three electron beams, and having an outer periphery, and being arranged on the outer peripheries of the funnel section and the neck section, comprising:

first deflection means producing mainly a pincushion type magnetic field to deflect the three electron beams emitted from said electron gun assembly in a first direction in which said three electron beams are arranged; and second deflection means producing mainly a barrel type deflection magnetic field to deflect said three electron beams in a second direction perpendicular to said first direction, at least one pair of permanent magnets arranged at an electron gun side of the deflection device and symmetrically with respect to said axis and having reverse poles opposed to each other so as to produce a pincushion type stationary magnetic field for correcting deflection aberrations of said three electron beams by the second deflection means and statically converging said three electron beams, wherein, defining the tube axis as a Z-axis, the in-line direction of the electron beams as an X-axis, and the direction perpendicular to both the Z-axis and the X-axis as a Y-axis, and where the X-axis and the Y-axis together define an XY plane, said at least one pair of magnets are located in the XY plane and arranged around the Z-axis clockwise when viewed from the panel section, said at least one pair of magnets including a first magnet oriented symmetrical to said Y-axis and such that an N pole thereof is adjacent the Y-axis and a second magnet oriented such that an N pole thereof is directed to an S pole of the first magnet, and wherein a length of said permanent magnets if shorter than a distance between said two side beams emitted from said electron gun assembly.

11. The device according to claim 10, wherein said permanent magnets are arranged in parallel to said first direction.

12. A deflection device as in claim 10, wherein said at least one pair of permanent magnets is arranged on an end surface of said electron gun assembly and extending from said end surface.

13. A deflection device for use in a color cathode ray tube including an axis, a panel section, a funnel section having an outer periphery and a neck section having an in-line type electron gun assembly for producing three electron beams housed therein and having an outer periphery, and being arranged on the outer peripheries of the funnel section and the neck section, comprising:

first deflection means producing mainly a pincushion type magnetic field to deflect the three electron beams emitted from said electron gun assembly in a first direction in which said three electron beams are arranged; and second deflection means producing mainly a barrel type deflection magnetic field to deflect said three electron beams in a second direction perpendicular to said first direction, at least one pair of permanent magnets arranged at an electron gun side of the deflection device and which produces stationary magnetic fields for correcting deflection aberrations of said three electron beams by the second deflection means, one pair of said permanent magnets being arranged symmetrically with respect to said axis and having reverse poles opposed to each other, the other pair of said permanent magnets arranged in a direction perpendicular to said first direction and symmetrically with respect to said axis and having reverse poles opposed to each other, wherein, defining the tube axis as a Z-axis, the in-line direction of the electron beams as an X-axis, and the direction perpendicular to both the Z-axis and the X-axis as a Y-axis, and where the X-axis and the Y-axis together define an XY plane, said at least one pair of magnets are located in the XY plane and arranged around the Z-axis clockwise when viewed from the panel section, said at least one pair of magnets including a first magnet and a second magnet oriented such that an N pole thereof is directed to an S pole of the first magnet and wherein a length of said permanent magnets is shorter than a distance between said two side beams emitted from said electron gun assembly, and wherein a magnetic flux density of said one pair of said permanent magnets is larger than that of said another pair of said permanent magnets at central portions of pole surfaces thereof.

14. The device according to claim 13, wherein said one pair of said permanent magnets are arranged in parallel to said first direction and said another pair of said permanent magnets are arranged in parallel to said second direction.

15. A deflection device as in claim 13, wherein said at least one pair of permanent magnets is arranged on an end surface of said electron gun assembly and extending from said end surface.

* * * * *